US007296320B2

(12) United States Patent
Cronin

(10) Patent No.: US 7,296,320 B2
(45) Date of Patent: Nov. 20, 2007

(54) ROTARY BUFFING DEVICE USING EXTENDING MATERIAL

(76) Inventor: John W. Cronin, 14139 Paradise Point Rd., Palm Beach Gardens, FL (US) 33410

( * ) Notice: Subject to any disclaimer, the term of this patent is extended or adjusted under 35 U.S.C. 154(b) by 199 days.

(21) Appl. No.: 10/641,051

(22) Filed: Aug. 15, 2003

(65) Prior Publication Data

US 2004/0107527 A1 Jun. 10, 2004

Related U.S. Application Data

(60) Provisional application No. 60/418,704, filed on Oct. 17, 2002.

(51) Int. Cl.
*A47L 11/14* (2006.01)
*B05C 17/10* (2006.01)

(52) U.S. Cl. ..... 15/230.16; 15/230.19

(58) Field of Classification Search ..... 15/97.3, 15/230.14, 230.16, 230.19
See application file for complete search history.

(56) References Cited

U.S. PATENT DOCUMENTS

| | | | | | |
|---|---|---|---|---|---|
| 317,800 | A | * | 5/1885 | Knipe | 15/230.14 |
| 1,118,153 | A | * | 11/1914 | Sanborn | 15/230.16 |
| 1,559,080 | A | * | 10/1925 | Fields | 15/230.16 |
| 1,726,587 | A | * | 9/1929 | Rein et al. | 15/230.16 |
| 2,423,992 | A | | 7/1947 | Nordgren et al. | |
| 2,440,856 | A | | 5/1948 | Harrison | |
| 2,516,870 | A | | 8/1950 | Harrison | |
| 2,638,617 | A | * | 5/1953 | Doering | 15/230.16 |
| 2,668,398 | A | * | 2/1954 | Busch et al. | 15/230.14 |
| 2,704,916 | A | | 3/1955 | Peterson | |
| 2,755,608 | A | | 7/1956 | Peterson | |
| 2,771,720 | A | * | 11/1956 | Field | 451/469 |
| 2,785,516 | A | * | 3/1957 | Hendrickson | 15/230.14 |
| 2,805,530 | A | | 9/1957 | Schaffner | |
| 2,816,403 | A | | 12/1957 | Peterson | |
| 3,191,208 | A | | 6/1965 | Churchill | |
| 3,357,141 | A | * | 12/1967 | Annis, Jr. | 451/352 |
| 3,520,090 | A | | 7/1970 | Lee | |
| 3,869,833 | A | | 3/1975 | Belanger | |
| 4,004,316 | A | * | 1/1977 | Ali | 15/230.16 |
| 4,133,146 | A | | 1/1979 | De Cola | |
| 4,164,053 | A | * | 8/1979 | Shelstad | 15/97.3 |
| 4,177,611 | A | | 12/1979 | Carr-Rollett | |
| 4,194,260 | A | * | 3/1980 | Culp | 15/230.14 |
| 4,200,947 | A | | 5/1980 | Ali | |
| 4,200,965 | A | | 5/1980 | Roth | |

(Continued)

*Primary Examiner*—Randall Chin
(74) *Attorney, Agent, or Firm*—Arent Fox LLP

(57) ABSTRACT

A polishing, buffing, compounding, and cleaning device incorporating rotary motion. The outer body of the invention includes two components. At least one of the components has a base and a plurality of projection members extending in a uniform direction away from the base. Projection members are spatially separated from one another, creating space in between each pair of adjacent projection members. At least one of the components is able to receive the projection members, thereby coupling the two components and forming the outer body. A plurality of extending material, such as disposable cloth or shop towels, is inserted in the empty space in between the projection members, such that both ends of each extending material extends radially from the central body. In one variation, the outer body is connected to rotary machinery, such as a drill, via a rotation rod extending from the outer body, to the rotary machinery, so as to provide rotary motion.

53 Claims, 5 Drawing Sheets

U.S. PATENT DOCUMENTS 4,277,917 A * 7/1981 Ali et al. ..... 451/467
4,585,226 A * 4/1986 LaBate ..... 271/264
4,882,879 A 11/1989 Warner et al.
4,967,440 A * 11/1990 Belanger ..... 15/230.14
5,185,970 A 2/1993 Fiocchi
5,207,032 A 5/1993 Frymier et al.
5,321,919 A 6/1994 Scheider et al.
5,329,730 A 7/1994 Scheider et al.
5,461,750 A 10/1995 Kaiser
5,477,582 A 12/1995 Yamashita
5,542,352 A 8/1996 Blackman et al.
5,560,744 A 10/1996 Schaffner III
5,628,679 A 5/1997 Shiga
5,784,748 A * 7/1998 Belanger et al. ..... 15/230.14
5,813,076 A * 9/1998 Belanger et al. ..... 15/97.3
5,890,249 A 4/1999 Hoffman
6,021,556 A * 2/2000 Belanger et al. ..... 29/450
6,035,482 A * 3/2000 Belanger et al. ..... 15/230.14
6,109,811 A * 8/2000 Song ..... 401/289
6,191,084 B1 2/2001 Christianson
6,202,279 B1 * 3/2001 Belanger et al. ..... 29/428
6,289,544 B1 * 9/2001 Kirikian ..... 15/97.3
6,295,687 B1 10/2001 Dehart
6,298,517 B1 10/2001 McKay
6,322,435 B1 11/2001 Hanosh
6,405,403 B1 6/2002 McKay

* cited by examiner

FIG.1C
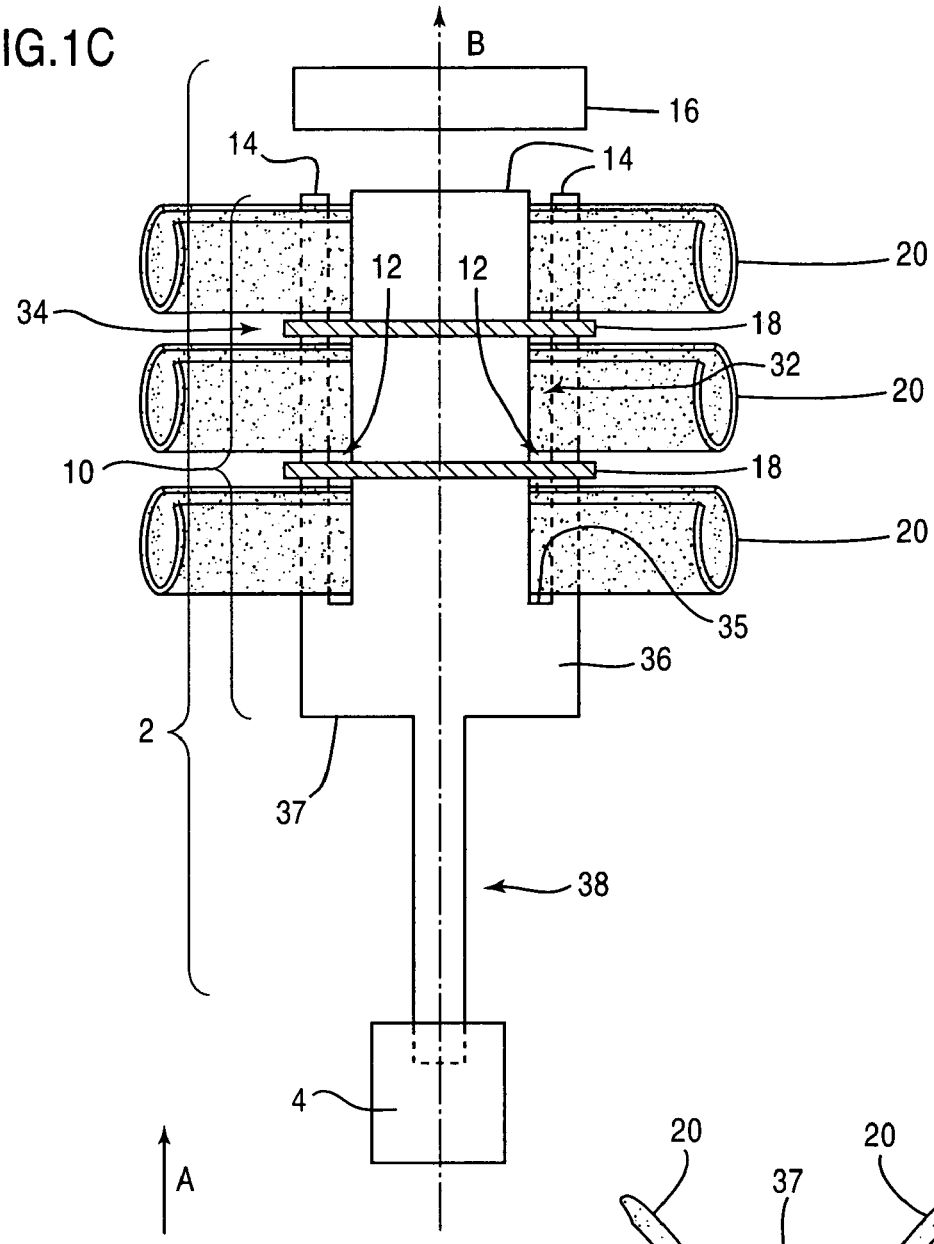
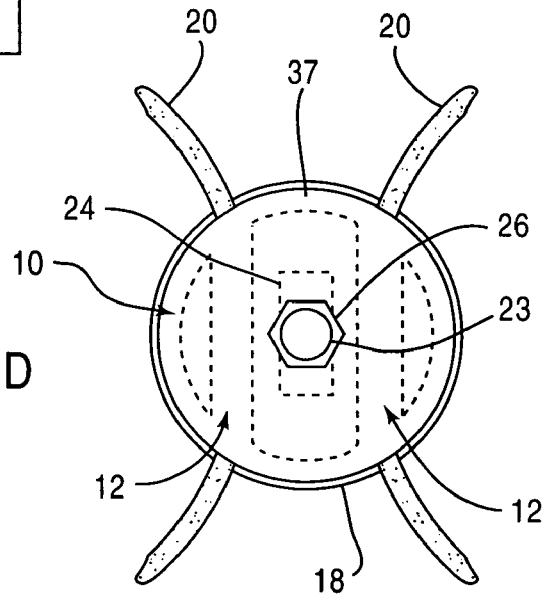
FIG.1D

ROTARY BUFFING DEVICE USING EXTENDING MATERIAL

This nonprovisional application claims the benefit of U.S. Provisional Application No. 60/418,704, filed Oct. 17, 2002.

BACKGROUND OF THE INVENTION

1. Field of the Invention

The present invention relates to a device for cleaning, compounding, polishing, brushing, burnishing and buffing that uses extending material elements, and in particular, to a device that accomplishes such results using the rotary motion of a plurality of standard-sized, disposable shop towels, paper towels, or surgical towels that are readily available at commercial vendors.

2. Background of the Technology

Many devices for buffing only operate when the buffing materials are pressed against the material to be buffed, and are thus difficult to use for at least this reason. The following devices exemplify these types of buffing devices. U.S. Pat. No. 5,890,249 to Hoffman discloses a multi-purpose vibrational cleaning, scrubbing, buffing, and polishing device. U.S. Pat. No. 5,477,582 to Yamashita discloses a mop sheet holder and a corresponding mop sheet. U.S. Pat. No. 3,869,833 to Belanger discloses a rotary finishing wheel. U.S. Pat. Nos. 6,298,517 and 6,405,403 to McKay disclose a cleaning tool with removable cleaning sheets. U.S. Pat. No. 5,542,352 to Blackman, et al., discloses a method and apparatus for cleaning, wiping, scouring, and abrading.

Additionally, conventional buffing devices may extend radially from the central axis, but the buffing sheets are typically not readily disposable or otherwise easy to obtain, and instead must be custom manufactured to fit the device. The following patents disclose these types of devices. U.S. Pat. No. 2,805,530 to Schaffner discloses a wheel-shaped, rotary finishing apparatus that may be used to buff. U.S. Pat. No. 5,560,744 to Schaffner III discloses a rotary buffing wheel in which layers of fabric attached to the wheel extend radially from the central axis of the wheel.

Some buffing devices, in which the buffing materials extend radially from the body, secure the buffing materials to the body, which is located on the central axis of the device, by using fastening devices, rather than friction, which for example, may unnecessarily complicate the device to make it difficult to use. Examples of these types of devices include the following. U.S. Pat. No. 6,295,687 to Dehart discloses a buff section assembly and method of making the assembly. U.S. Pat. No. 2,423,992 to Nordgren et al. discloses a rotary buffing tool in which wiping elements rotate about a rotary shank.

Many embodiments of conventional buffing devices, in which the buffing fingers extend radially, position the buffing fingers between grooves specially carved in the body and located on a central axis. Drawbacks of these devices include the fact that they do not use a fastening system to retain the buffing materials, and these devices typically do not have a retaining member attached to the body to keep the buffing fingers safely in the grooves during operation. The following patents disclose one or more of these features. U.S. Pat. No. 2,440,856 to Harrison discloses a finishing device in which a finishing element extends in two directions from a rotating central mandrel. U.S. Pat. No. 2,516,870 to Harrison discloses a finishing device wherein a flexible, plurality of material extends through a central mandrel so that it extends in two directions. U.S. Pat. No. 4,133,146 to De Cola discloses a rotary abrasive tool.

SUMMARY OF THE INVENTION

The present invention overcomes the above-mentioned problems, as well as others, by providing an apparatus that includes a rotary, mechanical device that is easily assembled, and for which extending material (also referred to herein "extending material elements"), such as shop towels, may be quickly and easily replaced. The present invention provides a multi-purpose device to clean, buff, abrade, polish, compound, burnish, and perform similar functions by using a plurality of extending material, such as disposable shop towels, extending radially from a main body.

One embodiment uses a two-portion body that provides an area for the extending material to be inserted and retained during use. The extending material, while retained, extends radially from the outer body, thereby allowing functions, such as cleaning, compounding, abrading, buffing, and polishing, of objects located peripherally to the main body. Moreover, the present invention allows the user to easily replace and/or dispose the extending material of the invention with readily available extending material, such as standard disposable shop towels, surgical towels, or paper towels. In one embodiment, the extending material is fixed to the mechanical device using friction, and therefore, in this embodiment, the extending materials do not require complex fastening features. Optionally retaining rings are used to further secure the extending material.

In a second embodiment, the plurality of extending material, such as shop towels, are held in between two complementary portions that each include extensions and that are coupled to form the outer body. The device is connected along its central axis to a rotary machine, such as a drill, which provides the power for the rotating motion.

Another feature of the present invention is that it provides a cost effective method for cleaning. The plurality of extending material, such as shop towels, are ready-made and readily available at commercial centers selling cleaning supplies. The present invention does not require specialized replacement parts, which are typically high in cost.

The present invention also provides a cleaning device that may be assembled and disassembled quickly and simply. The extending material, such as the shop towels, may be efficiently replaced as the material becomes soiled, or at the discretion of the user. Removal of the towels only requires disengaging of the two components that comprise the outer body of the invention. Alternatively, the user may manually pull one end of a shop towel to unthread and remove the towel from the fully assembled device.

Other features of the present invention will become apparent from the following detailed description considered in connection with the accompanying drawings, which disclose multiple embodiments of the present invention. It should be understood, however, that the drawings are designed for the purpose of illustration only and not as a definition of the limits of the invention. Additional advantages and novel features of the invention will also become more apparent to those skilled in the art upon examination of the following or upon learning by practice of the invention.

BRIEF DESCRIPTION OF THE DRAWINGS

In the drawings, similar reference characters denote similar elements throughout several views and embodiments.

FIG. 1C is an exploded front view of one embodiment of the present invention showing the detached cap and a plurality of shop towels attached to the main body;

FIG. 1D is an exploded bottom view of one embodiment of the present invention illustrating the bottom of the main body, the retainer nut, the central rod, and plurality of shop towels;

DETAILED DESCRIPTION

This invention provides an apparatus for performing a number of functions, including buffing, cleaning, compounding, polishing, burnishing, and abrading, using rotary power supplied by a rotary machine. Extending members are inserted into the outer body of the invention and are retained using friction. When assembled, the plurality of extending members extend radially from the outer body of the invention. The user of the invention positions the invention such that the extending members come in contact with an intended surface. The extending members may be easily replaced and disposed of at the discretion of the user. There are numerous embodiments for this invention. The detailed description and drawings present two embodiments and several variations of these embodiments, but do not encompass all embodiments for this invention, additional variations of which will be apparent to those skilled in the art.

Figure 1A:
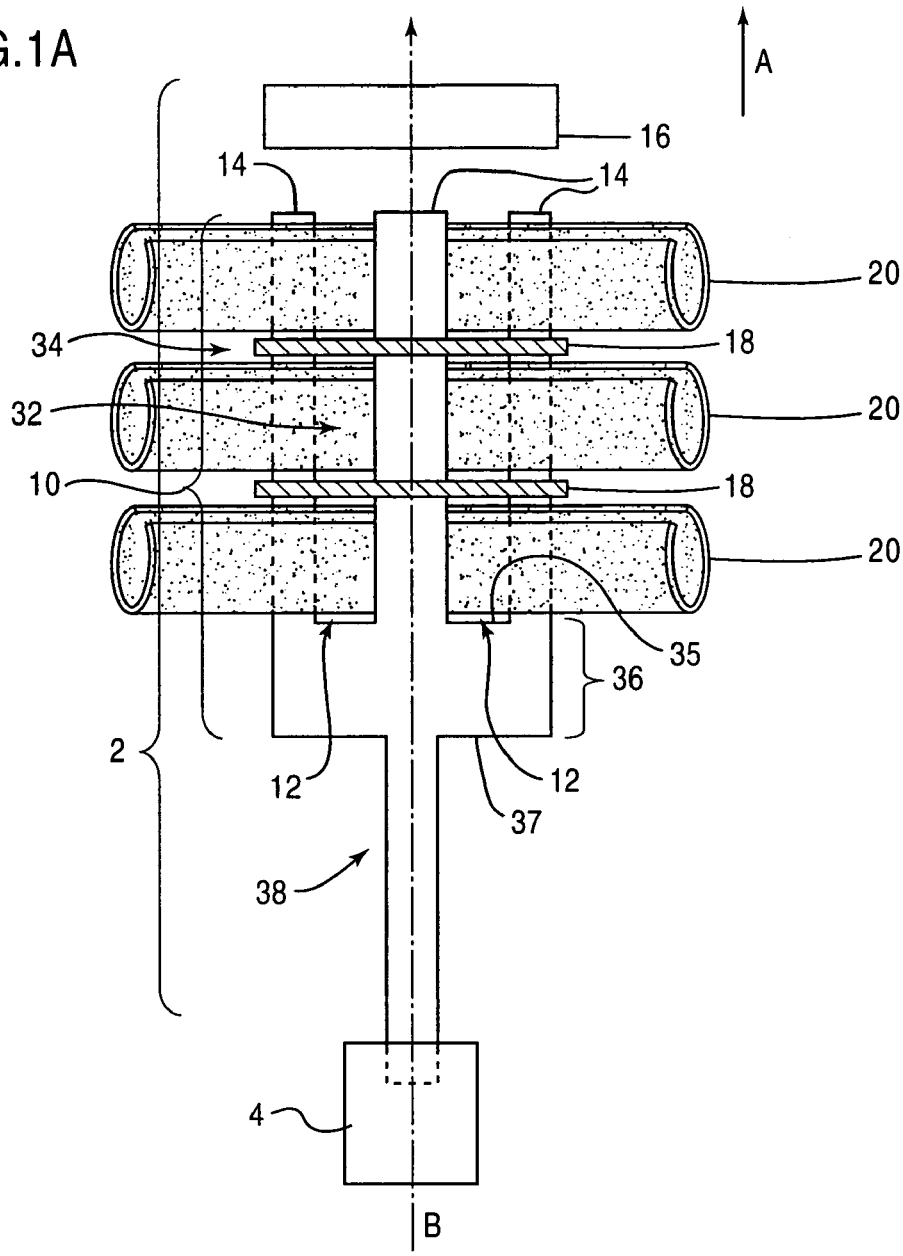
FIG. 1A is an exploded side view of a first embodiment of the present invention showing the detached cap, a plurality of shop towels attached to the main body and the rotation rod connecting to rotating machine.
Figure 1B:
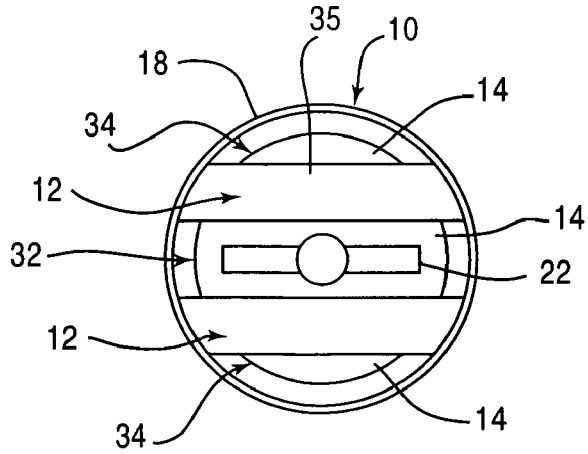
FIG. 1B is an overhead view of the another embodiment of the present invention, with the cap and extending materials removed, but with holder rings around the circumference of the main body and a central cavity for detaching the rotation rod.

Referring to the drawings, FIGS. 1A-1E show a first embodiment of the present invention. As shown in FIGS. 1A and 1C, the outer body of the invention is generally designated by the reference numeral 2 and the main body is generally designated by the reference numeral 10. The main body 10, which may be of any shape, such as cylindrical, spherical, or cubical, is comprised of a base 36 and a plurality of projection members 32, 34. The embodiment shown in FIG. 1A includes three projection members: two outside projection members 34 and one middle projection member 32. One end of the projection members can be formed with the base 36, or they can be fixed to the base 36 by any of a number of methods, including, for example, welding or chemical bonding. In one embodiment, the projection members 32, 34 extend in a general, first direction ("A") from the first face 35 of the base 36. This embodiment also includes slots 12 between projection members 32, 34. The area and volume of each slot 12 may vary in various embodiments. In this embodiment, the slot 12 (also referred to herein as "apertures") is formed by the space between each outside projection member 34 and the middle projection member 32. As shown in FIG. 1B, this embodiment has two such slots 12.

One end of the projection members 32, 34, also known as the distal end 14, receives a cap 16. As shown in 1E, the cap 16 is placed over or on top of the distal end 14 of the projection members 32, 34. The cap 16 is retained by any number of methods, such as via a retaining lip or via threads on the inner surface of the cap 16 that fit corresponding features on the distal end 14 of the projection members 32, 34. In one embodiment, each projection member 32, 34 tapers at the distal end 14, forming a narrowed end, which receives the cap 16. Tapering this feature, for example, may ease assembly and disassembly.

A rotation rod 38 extends from the second face 37 of the base to a rotary machine 4, such as a handheld drill. The rotation rod 38 may be formed or affixed to the main body 10 in a similar manner as the projection members 32, 34.

Figure 1E:
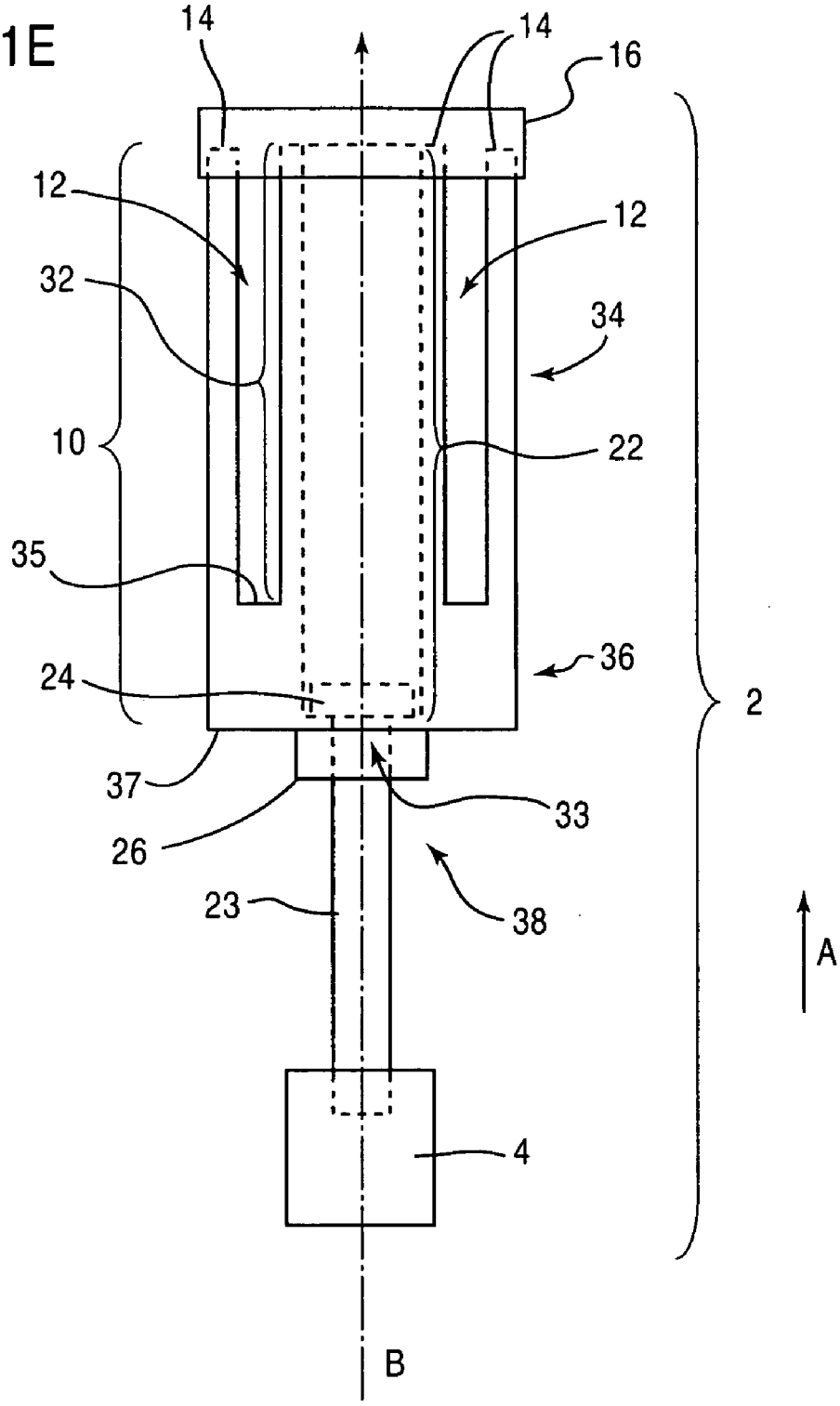
FIG. 1E is an exploded front view of one embodiment of the present invention with the extending material removed, illustrating main body, the retainer nut, the central cavity and the rotation rod.

In one embodiment of the present invention, the rotation rod 38 can be disassembled and removed from the main body 10, as further shown in FIG. 1E. In this embodiment, the main body 10 has a central cavity 22, which extends from the second face 37 of the base 36 to the first face 35 of the base 36, and continues to extend through the middle projection member 32. The rotation rod 38 has T-shape or any similar shape allowing the rotation rod 38 to be retained within the central cavity 22 as described further below. In one embodiment, the rotation rod 38 is comprised of two sub-parts: 1) a central rod 23 is perpendicularly formed or affixed to 2) a central anchor 24. The rotation rod 38 and main body 10 are assembled such that the central rod 23 of the rotation rod 38 is inserted in the central cavity 22 from the first face of the base through the middle projection member 32. The rotation rod 38 is positioned by pulling the central rod 23 to the second face 37 of the base 36 until the central anchor 24 rests against the first face 35 of the base 36. As shown in 1E, in one embodiment, the second face 37 of the base 36 has a receiving area 33 to fixedly position the central anchor 24. The central anchor 24 and corresponding receiving area 33 on the base 36 may be arbitrarily held by any number of retaining features, such as adhesives or a retainer nut that abuts the second face 37 of the base 36. In one embodiment of the present invention, as shown in FIGS. 1D and 1E, a retainer nut 26 is positioned against the second face 37 of the base 36 and is secured to the rotation rod 38 using, for example, thread features on the inner surface of the retainer nut and the exterior of the rotation rod 38.

A plurality of extending material 20, such as shop towels, paper towels, or surgical towels, are inserted through the slots 12. In one embodiment of the present invention, the extending material 20 is manipulated to fit through the slots 12, such as by rolling, folding, or similar compacting methods. In one embodiment of the invention, two pieces of extending material 20, which form a first tier, are inserted in the slots 12, such that the surface of each extending material 20 is positioned flush against the first face 35 of the base 36 and in between two projection members 32, 34. The extending materials 20 are positioned so as to extend beyond both sides of the slot 12. FIG. 1D illustrates an overhead view of one relationship between the extending material 20 and the main body 10 while the present invention is in use. Additional extending material 20 may be positioned on top of the first tier until the slots 12 are filled.

As shown in FIG. 1D, in one variation of the invention, a holder ring 18, which, for example, is of a complementary shape as the main body 10 having, for example, an inner diameter slightly larger than the main body 10, is slidably placed over the outer circumference of the main body 10, such that it encompasses one or more of the projection members 32, 34 so as to secure the first tier of extending material 20. In one embodiment of the present invention, successive tiers of extending material 20 are then inserted in the slots 12 of the main body 10, with additional holder rings 18 positioned in between each tier of extending material 20.

Upon completion of the extending material insertion, the last tier of extending material 20 rests just below the distal end 14 of projection members 32, 34. The cap 16 is placed over the projection members 32, 34 so as to secure the extending members 20 to the main body 10.

In one embodiment of the invention, a rotary machine 4, such as a drill, for example, is then optionally attached to the rotation rod 38 so as to provide a power source for the main body 10 of the invention to rotate the outer body 2 around its central axis ("B").

Figure 2A:
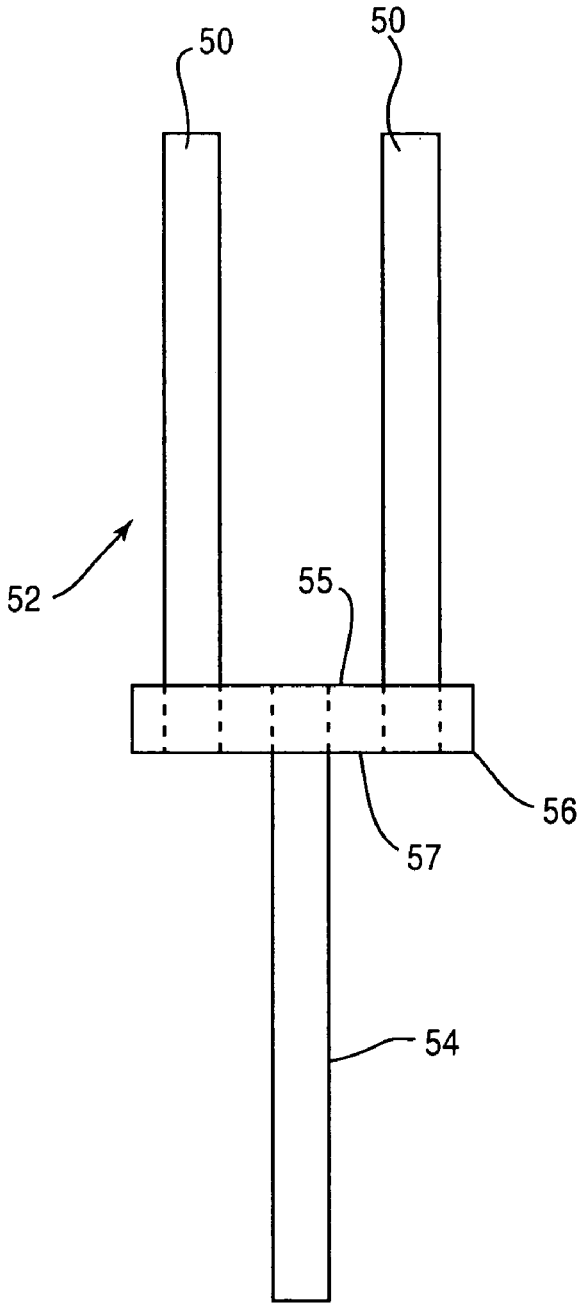
FIG. 2A is a front view of the tool base, first disc, plurality of base rods, and rotation rod of a second embodiment of the present invention.

A second embodiment of the current invention is shown in FIGS. 2A-2E. This embodiment of the present invention is comprised of two portions, a tool base 52 and a tool end 62, which are coupled together to form an outer body 68. As illustrated in FIG. 2A, the tool base 52 is comprised of a first disc 56, which may be of any of a variety of cross-sectional shapes, and a plurality of base rods 50 extending from a first face 55 of the first disc 56. A variation of the invention may have a rotation rod 54 extending from the second face 57 of the first disc 56. The base rods 50 and rotation rod 54 are formed or affixed into position on the first disc 56 by any number of methods, such as welding, chemical bonding, or other securing and retaining features.

Figure 2B:
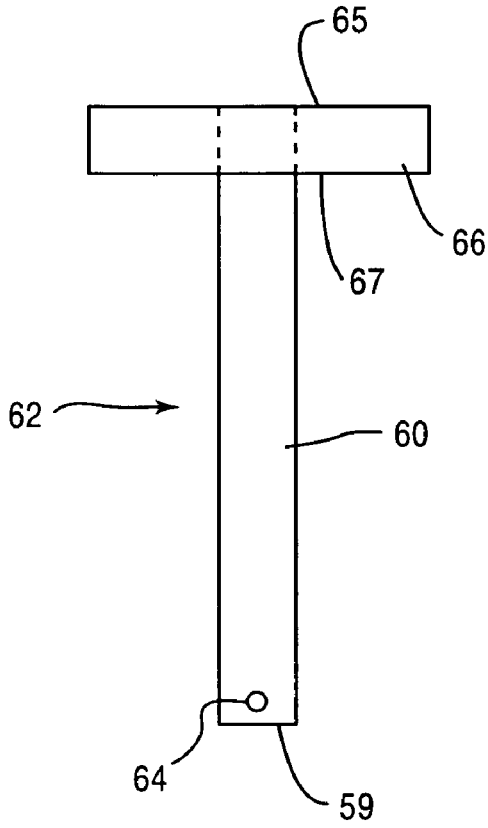
FIG. 2B is a front view of the tool end, second disc, end rods, and retainer member of the second embodiment of the present invention.
Figure 2C:
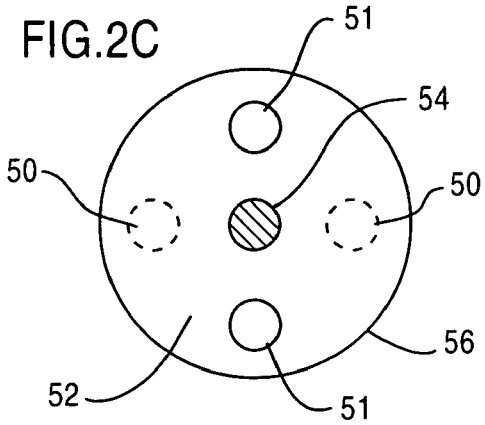
FIG. 2C is a bottom view of the tool base, rotation rod, and first disc of the second embodiment of the present invention illustrating the plurality of apertures in the first disc in accordance with an embodiment of the present invention.
Figure 2D:
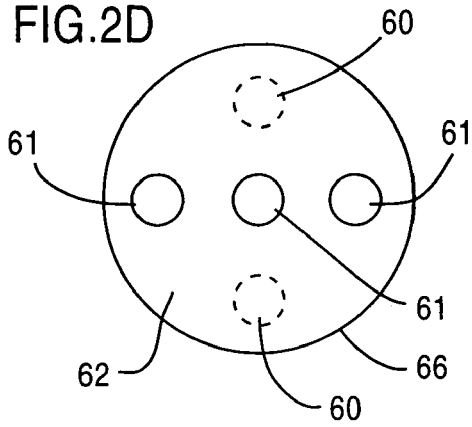
FIG. 2D is a bottom view of the tool end, and second disc of the second embodiment of the present invention illustrating the plurality of end openings in the second disc.

As further shown in FIG. 2C, interposed between the base rods 50 on the first face 55 of the first disc 56 are base openings 51, such as through holes, which are of any cross-sectional shape, so as to be complementary to the shape of the end rods 60. In the embodiment shown in FIG. 2C, the first disc 56 includes two base openings 51. The base openings 51 and plurality of base rods 50 are positioned in any manner, such as a symmetrical path, which may be in a circular pattern, as shown in FIGS. 2C and 2D, about the first disc 56. In one embodiment, the positions of the base openings 51 and plurality of base rods 50 on the first disc 56 are complementary to the position of the plurality of end rods 60 and end openings 61, respectively, on the second disc 66.

As illustrated in FIG. 2B, the tool end 62 is comprised of a plurality of end rods 60 extending from the first face 67 to the second face 65 of the second disc 66, which may be of any variety of cross-sectional shapes. The end rods 60 are formed or affixed to the second disc 66 using, for example, any of the methods to form or affix the base rods 50 to the first disc 56. In one embodiment, the first face 67 of the second disc 66 also has a plurality of end openings 61, such as through holes, interposed with the end rods 60. As illustrated in FIG. 2D, in this embodiment, the second disc 66 has two end openings 61, which are of any cross-sectional shape but are greater in diameter than the base rods 50. In one embodiment, the end openings 61 are positioned in between the end rods 60 in any path, including symmetrical paths, such as in a circular pattern, about the second disc 62. In one embodiment, the positions of the end openings 61 and end rods 60 are complementary to the position of base rods 50 and base openings 51 on the first disc 56. In the embodiment shown in FIGS. 2A-2E, the outer body 68 is assembled by engaging the tool base 52 and the tool end 62. The plurality of base rods 50 extend towards the tool end 62, and the plurality of end rods 60 extend towards the tool base 52. The tool end 62 and tool base 52 are arranged such that each base rod 50 and each base opening 51 align with the corresponding end opening 61 and a end rod 62, respectively. Hence, each base rod 52 has a complementary end opening 61, and each end rod 62 has a complementary base opening 51.

In one embodiment of the present invention, a retaining member 64, such as a retaining pin, retaining lock, adhesive, or other retaining feature or features, are located at the distal end 59 of the plurality of end rods 60. As shown in FIG. 2B, at least one end rod 60 contains a retainer member 64. In one variation of this invention, the end rods 60 are slightly longer than the base rods 50, and thus, when the invention is assembled, the end rods 60 extend through the base openings 51 to the second face 57 of the first disc 56. The retaining member 64 on the end rods 60 prevents the tool base 52 and tool end 62 from disengaging.

In one embodiment, when the tool end 62 and tool base 52 are engaged, the outer body 68, between the first disc 56 and second disc 66, contains a plurality of slots 70 interposed between the base rods 52 and the end rods 62.

A plurality of extending material elements 20, such as standard shop towels, are inserted in the slots 70. In one embodiment, the extending material element is manipulated, by folding, rolling, or otherwise compacting, to fit through the slots 70. Extending material elements 20 are stacked or placed side-by-side, until the slot 70 is filled. The amount of extending material 20 depends upon the amount of extending material 20 that is necessary to fill the slots 70. The extending material 20 is retained in the slots 70 by friction from, for example, the sides of the slots 70 and/or the compressing force of the disks 56, 66 produced upon assembly.

Figure 2E:
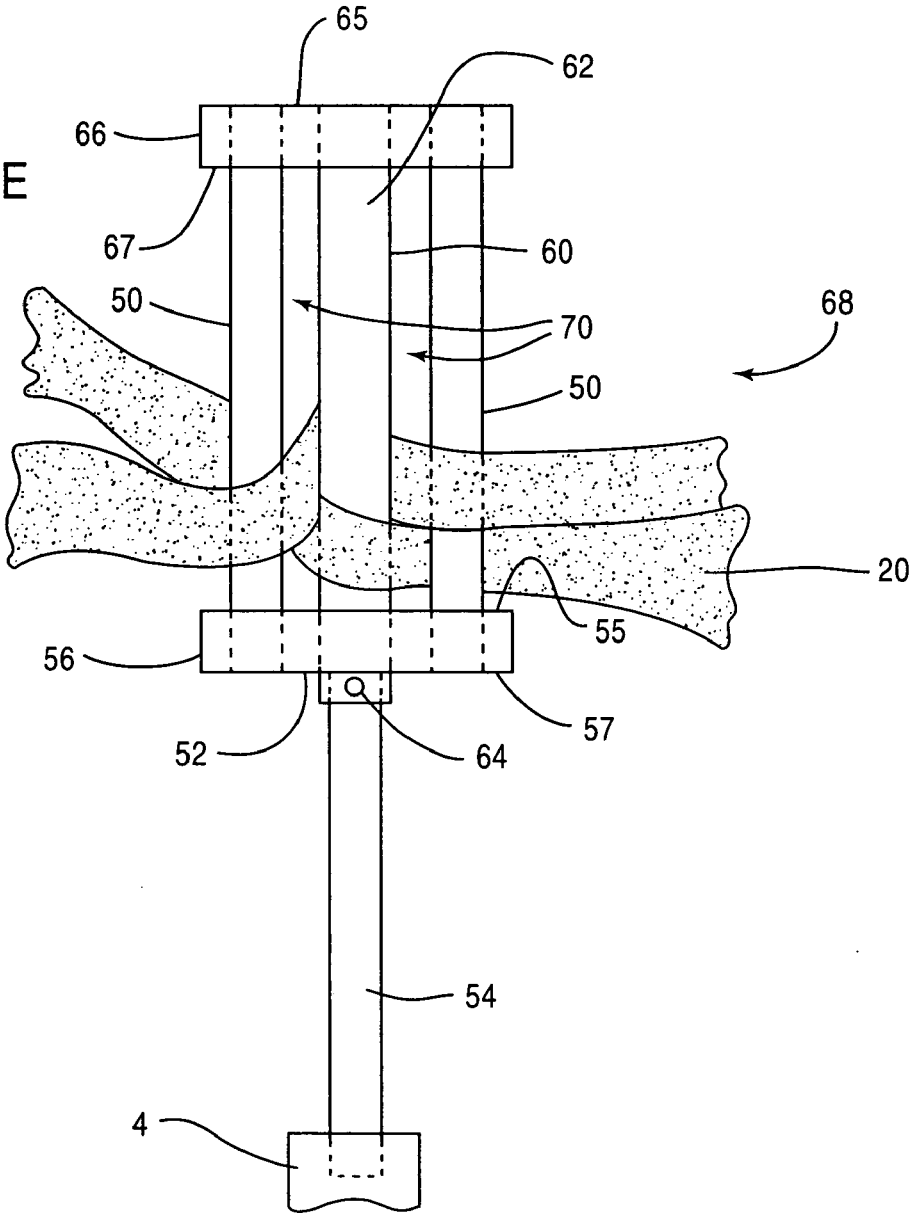
FIG. 2E is a front view of the second embodiment of the present invention illustrating the assembled invention without the shop towels intertwined between the end rods and the base rods.

As illustrated in FIG. 2E, in one embodiment, the invention is fully assembled when the outer body 68 is formed by engaging the tool end 62 with the tool base 52, and the plurality of extending members 20, such as shop towels 20, extends radially from the central axis of the outer body 68. In one embodiment, to replace or dispose of the extending 20 material, the retainer member 64 is unlocked and the tool end 62 is disengaged. Alternatively, the extending material 20 may simply be pulled out of the outer body 68 without disassembling the outer body 68.

In one embodiment, a rotation rod 54 extends from the second face 57 of the first disc 56 and connects to a rotary machine 4, such as a drill. Such a rotation rod 54 may be formed or assembled with this embodiment similar to that described with regard to the embodiment shown in FIGS. 1A-1E. This embodiment of the invention may be used with handheld machinery as well as larger machinery.

Example embodiments of the present invention have now been described in accordance with the above advantages. It will be appreciated that these examples are merely illustrative of the invention. Many variations and modifications will be apparent to those skilled in the art.

The invention claimed is:

1. A rotary buffing device, comprising:

a plurality of material elements having an elongated form; and a body including first and second portions contiguously coupled to each other in a mating relation and having a plurality of parallel slots therebetween extending through the body, wherein each slot is configured to receive the plurality of material elements in axial succession along the axis of the body from the first portion to the second portion, each of the plurality of material elements extending completely therethrough from one end of each slot to an opposite end.

2. The rotary buffing device according to claim 1, wherein the material elements include at least one selected from a group consisting of shop towels, surgical towels, and paper towels.

3. The rotary buffing device according to claim 1, wherein the body further comprises:

a base; and a rotation rod extending from the base.

4. The rotary buffing device according to claim 3, wherein the rotation rod is attached to a rotary machine.

5. The rotary buffing device according to claim 1, wherein:

the first portion comprises a tool base having a first disc and at least one base rod extending from the first disc;

the second portion comprises a tool end having a second disc and at least one end rod extending from the second disc; and wherein the body is defined by coupling the tool base and tool end, and the plurality of parallel slots are formed via the at least one base and end rod; and the plurality of material elements are received within each slot formed by the at least one base and end rod.

6. The rotary buffing device of claim 5, wherein each base rod is attached to the first disc of the tool base by one selected from a group consisting of welding, mechanically connecting, and chemical bonding.

7. The rotary buffing device of claim 5, wherein each end rod is attached to the second disc of the tool end by one selected from a group consisting of welding, mechanically connecting, and chemical bonding.

8. The rotary buffing device of claim 5, wherein the body further comprises:

a rotation rod extending from a first disc of the tool base.

9. The rotary buffing device of claim 8, wherein the at least one base rod extends in a first direction from the first disc, and wherein the rotation rod extends from a second direction from the first disc.

10. The rotary buffing device of claim 9, wherein the second direction is opposite the first direction.

11. The rotary buffing device of claim 8, wherein the rotation rod is connectable to a rotary machine.

12. The rotary buffing device of claim 8, wherein the rotation rod is attached to the first disc by one selected from a group consisting of welding, mechanically connecting, and chemical bonding.

13. The rotary buffing device of claim 8, wherein the rotation rod is formed to the tool base.

14. The rotary buffing device of claim 5, wherein at least one base rod comprises:

a retaining member.

15. The rotary buffing device of claim 14, wherein the retaining member is a retaining pin.

16. The rotary buffing device of claim 14, wherein each end rod has a length and each base rod has a length wherein the length of the at least one end rod is greater than the length of the at least one base rod.

17. The rotary buffing device of claim 5, wherein the at least one end rod comprises:

a retaining member.

18. The rotary buffing device of claim 5, wherein the first disc of the tool base comprises a plurality of base openings.

19. The rotary buffing device of claim 18, wherein the second disc of the tool end comprises a plurality of end openings.

20. The rotary buffing device of claim 19, wherein the base openings and end openings comprise throughholes.

21. The rotary buffing device of claim 5, wherein the plurality of material elements are selected from a group consisting of shop towels, paper towels, and surgical towels.

22. The rotary buffing device of claim 5, wherein each of the plurality of material elements is frictionally retained in the plurality of parallel slots.

23. The rotary buffing device of claim 5, wherein each of the plurality of material elements is compacted for receiving within the plurality of parallel slots.

24. The rotary buffing device of claim 5, wherein each of the plurality of material elements is compacted by one selected from a group consisting of folding and rolling.

25. A rotary buffing system, comprising:

a rotary device including:

a plurality of material elements having an elongated form; and a body including first and second portions contiguously coupled to each other in a mating relation and having a plurality of parallel slots therebetween extending through the body, wherein each slot is configured to receive the plurality of material elements in axial succession along the axis of the body from the first portion to the second portion, each of the plurality of material elements extending completely therethrough from one end of each slot to an opposite end; and a rotary machine attached to the rotary device.

26. The rotary buffing system according to claim 25, wherein the material elements include at least one selected from a group consisting of shop towels, surgical towels, and paper towels.

27. The rotary buffing system according to claim 25, wherein the body further comprises:

a base; and a rotation rod extending from the base.

28. A rotary device, comprising:

a body having a base and a plurality of projection members directly connected thereto, a plurality of parallel slots being formed by the plurality of projection members and between two contiguously coupled projection members, the plurality of parallel slots extending through the body;

a cap attached directly to each of the plurality of projection members; and a plurality of material elements having an elongated form being received within the plurality of parallel slots formed by the plurality of projection members and each of the plurality of material elements extending completely therethrough from one end of the body to an opposite end.

29. The rotary device of claim 28, wherein the body further comprises:

a rotation rod extending from the base.

30. The rotary device of claim 29, wherein the plurality of projection members extend in a first direction from the base, and wherein the rotation rod extends in a second direction from the base.

31. The rotary device of claim 30, wherein the second direction is opposite the first direction.

32. The rotary device of claim 29, wherein the rotation rod is connectable to a rotary machine.

33. The rotary device of claim 29, wherein the body includes a central cavity for retaining the rotation rod.

34. The rotary device of claim 33, wherein the central cavity includes a first opening end and a second opening end, wherein the body includes a receiving area at the second opening end of the cavity, and wherein the rotation rod includes a central rod portion and a central anchor, the receiving area retaining the rotation rod via the central anchor.

35. The rotary device of claim 34, wherein the rotary device further comprises:

a retaining member attachable to the central rod portion.

36. The rotary device of claim 35, wherein the central anchor and the retaining member sandwichably retain the rotation rod about the receiving area.

37. The rotary device of claim 35, wherein the central rod portion includes an external thread, and wherein the retaining member includes an internal thread matable with the central rod external thread.

38. The rotary device of claim 37, wherein each of the plurality of projection members is attached to the base by one selected from a group consisting of welding, mechanically connecting, and chemical bonding.

39. The rotary device of claim 29, wherein the rotation rod is formed to the base.

40. The rotary device of claim 29, wherein the rotation rod is attached to the base by one selected from a group consisting of welding, mechanically connecting, and chemical bonding.

41. The rotary device of claim 28, wherein each of the plurality of projection members is attached to the base.

42. The rotary device of claim 41, wherein each of the plurality of projection members is formed to the base.

43. The rotary device of claim 28, wherein at least one of the plurality of projection members includes an external thread, and wherein the cap includes an internal thread matable with the external thread.

44. The rotary device of claim 28, wherein the cap includes a retaining lip, and wherein at least one of the plurality of projection members includes a retaining lip receiving feature, the cap being attachable to the plurality of projection members via the retaining lip and the retaining lip receiving feature.

45. The rotary device of claim 28, wherein the plurality of material elements are selected from a group consisting of shop towels, paper towels, and surgical towels.

46. The rotary device of claim 28, wherein each of the plurality of material elements is frictionally retained in at least one slot.

47. The rotary device of claim 28, further comprising: at least one holder ring fitable about the plurality of projection members.

48. The rotary device of claim 47, wherein at least one of the plurality of material elements is retained by the at least one holder ring.

49. The rotary device of claim 28, wherein each of the plurality of material elements is compacted for receiving within the plurality of parallel slots.

50. The rotary device of claim 49, wherein each of the plurality of material elements is compacted by one selected from a group consisting of folding and rolling.

51. The rotary device of claim 28, wherein at least one of the plurality of projection members is tapered.

52. The rotary device of claim 28, wherein the attached cap retains the plurality of material elements.

53. A rotary buffing device, comprising:

a plurality of material elements having an elongated form; and a body including first and second portions contiguously coupled to each other in a mating relation and having a plurality of parallel slots therebetween extending through the body from end to end, wherein each slot is configured to receive the plurality of material elements in axial succession along the axis of the body from the first portion to the second portion, each of the plurality of material elements extending completely therethrough and projecting from both ends of each of the plurality of parallel slots.

* * * * *